US010472164B2

(12) United States Patent
Bergeron et al.

(10) Patent No.: US 10,472,164 B2
(45) Date of Patent: Nov. 12, 2019

(54) TRI-FOLD EGG CARTON FOR VARIOUS SIZE JUMBO EGGS

(71) Applicant: Tekni-Plex, Inc., Wayne, PA (US)

(72) Inventors: Mark A. Bergeron, Monroe, GA (US); Babu Kuruvilla, Griffin, GA (US); Roger P. Lichtle, Decatur, IN (US)

(73) Assignee: Tekni-Plex, Inc., Wayne, PA (US)

( * ) Notice: Subject to any disclaimer, the term of this patent is extended or adjusted under 35 U.S.C. 154(b) by 290 days.

(21) Appl. No.: 15/470,184

(22) Filed: Mar. 27, 2017

(65) Prior Publication Data

US 2018/0273284 A1 Sep. 27, 2018

(51) Int. Cl.
*B65D 85/32* (2006.01)
*B65D 81/113* (2006.01)

(52) U.S. Cl.
CPC ..... *B65D 85/32* (2013.01); *B65D 81/113* (2013.01)

(58) Field of Classification Search
CPC ..... B65D 85/32; B65D 81/133
See application file for complete search history.

(56) References Cited

U.S. PATENT DOCUMENTS

| | | | | |
|---|---|---|---|---|
| 2,668,652 | A * | 2/1954 | Russell | B65D 85/324 206/521.1 |
| 9,169,058 | B1 | 10/2015 | Ramirez et al. | |
| 9,340,349 | B2 | 5/2016 | Ramirez et al. | |
| 9,340,350 | B2 | 5/2016 | Ramirez et al. | |
| 2013/0048527 | A1 | 2/2013 | Ramirez et al. | |
| 2013/0183412 | A1 | 7/2013 | Ramirez et al. | |

* cited by examiner

*Primary Examiner* — Andrew T Kirsch
(74) *Attorney, Agent, or Firm* — Polsinelli, PC

(57) ABSTRACT

Tri-fold egg carton has a base and a cover each having a complementary matrix of egg receiving cells such that, when the cover is assembled on top of the base, the complementary cells encapsulate each egg in an individual cell pocket (see FIGS. 3-5). Each base cell and cover cell includes a central dome and first and second radially spaced apart circumferential hinges that surround the central dome, and lie radially inward of a lowermost standing ring, enabling the dome to move up and down above the plane of the standing ring (in the height direction of the closed carton) between multiple positions to accommodate jumbo eggs of varying dimensions (height and width) to hold them securely in their respective cell pocket. The base and cover further include full height cell posts with mating surfaces that engage in the assembled state. The carton further includes a lid which fits over the cover (of the assembled cover and base), in a secure and locked position.

20 Claims, 10 Drawing Sheets

TRI-FOLD EGG CARTON FOR VARIOUS SIZE JUMBO EGGS

FIELD OF THE INVENTION

The present invention relates to plastic egg cartons and more particularly to a tri-fold egg carton that will protect various size jumbo eggs in both oriented and non-oriented positions.

BACKGROUND

Egg cartons are subjected to multiple adverse mechanical forces and environmental conditions during filling, handling and transport between distribution centers, store shelves, and the ultimate consumer's home. They typically encounter automated equipment for filling, packaging, loading, unloading, stacking, restacking and transport. During each of these encounters, the goal is to resist egg breakage by stabilizing and holding the eggs in a protected environment, in a carton that can be manufactured in a cost effective manner.

Thus, many factors are taken into consideration in the design of egg cartons. Egg protection, resistance to stress or force, stackability, transportability, moisture resistance, aesthetic appearance, print surface area, weight, nestability/denestability, adaptability to accommodate various size eggs, and consistent manufacturing are factors which may be considered to varying degrees in the design of an egg carton.

Plastic egg cartons are available with flexible walls between the cell pockets to protect the eggs and prevent them from moving into adjacent cell pockets. However, during handling, such as while loading cases of egg cartons onto a grocery pallet, and then stacking the cases 5 to 6 high on the pallet, the cases/cartons may be thrown onto the pallets and/or bump into each other, causing the eggs to come out of their cell pockets and make contact from a hard side impact blow. Also, when scanning bar codes on lid tops, the eggs can be displaced and make contact. While one carton design may provide structural re-enforcements that accommodate and protect a specific egg size (e.g., medium, large, extra-large, or jumbo), few cartons can accommodate a range of sizes or even the variation in size that often occurs within a specific egg size category. For example, jumbo eggs can vary between super jumbo (weighing from 34 to 36 ounces per dozen, or 2.83 to 3.00 ounces per egg) and regular jumbo (weighing from 30 to 33 ounces per dozen or 2.5 to 2.75 ounces per egg). If even one egg out of a dozen moves in its cell pocket because it is slightly wider or shorter than the typical egg in the size group for which the carton was designed, it creates broken eggs for the retailer to clean up and one or more un-saleable cartons depending upon how far the broken egg results travel.

Thus, there is need for an improved egg carton construction to provide better egg protection for eggs of varying dimensions while encountering the adverse mechanical forces and environmental changes that typically occur during filing, packaging, transportation and storage. At the same time, there is a need to manufacture such cartons in a cost effective manner, provide overall carton dimensions that fit within standard case sizes and avoid a redesign of the existing handling equipment.

SUMMARY OF THE INVENTION

The present invention relates to an improved tri-fold plastic egg carton having one or more structural features that enable packaging of regular jumbo and super jumbo eggs in a 2×6 array in both oriented and non-oriented positions while allowing for easy filling, closing, handling and packing into shipping containers. As used herein, "jumbo eggs" includes a full range of regular jumbo egg sizes from 2.50 to 2.75 ounces per egg, or 30 to 33 ounces per dozen, and a full range of super jumbo egg sizes from 2.83 to 3.00 ounces per egg, or 34 to 36 ounces per dozen. Preferably, the carton can be used with standard egg grade equipment and the carton will fit into standard cases.

In one embodiment, the tri-fold egg carton has a base and a cover each having a complementary matrix of egg receiving cells such that, when the cover is assembled on top of the base, the complementary cells encapsulate each egg in an individual cell pocket (see FIGS. 3-5). Each base cell and cover cell includes a central dome and first and second radially spaced apart circumferential hinges that surround the central dome, and lie radially inward of a lowermost standing ring, enabling the dome to move up and down above the plane of the standing ring (in the height direction of the closed carton) between multiple positions to accommodate jumbo eggs of varying dimensions (height and width) to hold them securely in their respective cell pocket. The base and cover further include full height cell posts with mating surfaces that engage in the assembled state. The carton further includes a lid which fits over the cover (of the assembled cover and base), in a secure and locked position.

In accordance with one embodiment of the invention, the assembled base and cover form a plurality (e.g., a 2×6 matrix) of individual egg cell pockets that can accept the larger, heavier and more fragile jumbo eggs in both oriented and non-oriented positions, versus prior art containers that require a correct (oriented) positioning in the cells and more limited size variations. The present invention includes a larger cell construction able to hold a larger jumbo egg that is non-oriented, i.e., enabling the largest diameter of the egg to fit into the cell pocket of the base. By accommodating both oriented and non-oriented eggs, this allows more efficient processing, carton handling and placement into master containers. A larger cell post, between each 2×2 matrix of cells, provides a wider cell spacing that keeps the larger jumbo eggs a greater distance apart in both the 2-cell and 6-cell directions of the 2×6 matrix.

In accordance with one embodiment, a tri-fold plastic egg carton is provided comprising:

- a base, and a cover hingedly connected to one edge of the base for pivoting between open and closed positions, the base and cover each having a complimentary rectilinear matrix of cells that together form a rectilinear matrix of cell pockets for holding individual eggs when the cover is closed over the base;
- a lid hingedly connected to another edge of the base for pivoting between open and closed positions, wherein when the cover and base are in the closed position the lid can be closed over the cover to form an assembled carton;
- each cell pocket is sized to hold any different size variations of a jumbo egg, of from 2.50 to 3.00 ounces per egg, in an oriented or a non-oriented direction in the base cell;
- each cell of the base and lid having a bottom wall comprising:
- a lowermost peripheral standing ring defining a base plane;
- a recessed wall portion disposed radially inwardly from the peripheral standing ring and defining a central recessed area above the base plane, the recessed wall portion including a central dome in a concave out position in a relaxed state, a first circumferential hinge disposed radially outwardly of and surrounding the central dome, and a second circumferential hinge disposed radially outwardly of and surrounding the first hinge, the first and second hinges being in a contracted position in a relaxed state, wherein each of the upper and lower hinges are movable between their contracted position to one or more extended positions to move the central dome up and down in the central recessed area while remaining above the base plane while the central domes of the base cell and cover cell engage opposing ends of a jumbo egg of the different size variations and orientations.

In one embodiment, the carton has a 2×6 matrix of the cell pockets formed by a complementary 2×6 matrix of cells in each of the base and cover, and the carton is a solid sheet of clear polyester.

In one embodiment, the bottom wall has a thickness in a range of about 0.013 to about 0.022 inches In one embodiment, each cell has an arcuate, outwardly bowed sidewall portion sized to receive a major cell diameter of a jumbo egg in a range of about 1.75 to about 2.06 inches. Further, the egg cells are configured to receive jumbo eggs in a height range of 2.461 to 2.750 inches, between the central domes of a pair of base and cover cells.

In one embodiment, each cell has a sidewall and the sidewalls of two adjacent cells form a cell divider which prevents contact between eggs in the adjacent cells.

In one embodiment, the non-hinged peripheral edges of the lid, cover and base each having a lip edge, the lip edges of the cover and base mating when the cover is closed over the base, and the lip edge of the lid being disposed over the mating lip edges of the cover and base when the lid is closed over the cover.

In one embodiment, the assembled carton has a length of from about 11.62 to about 12.00 inches, a width of from about 3.95 to about 4.18 inches and a height of from about 2.62 to about 3.125 inches.

In one embodiment, the assembled carton is filled with jumbo eggs of the different size variations and orientations.

In one embodiment, a plurality of assembled egg cartons is arranged in a stack.

In one embodiment, a container holds the stack.

In one embodiment, the container is sized to hold a full case (30 dozen) or a half case (12 dozen) of the egg cartons.

In one embodiment, the plastic is one or more of polyester, polyethylene, polylatic acid, and polystyrene, including polymers, copolymers, mixtures and blends thereof.

In one embodiment, the carton comprises a solid sheet of clear polyester.

In one embodiment, the carton comprises a foamed sheet of polystyrene.

In one embodiment, the lid has four sidewalls and four corners connecting the sidewalls and has structural reinforcements provided in each sidewall and corner.

In one embodiment, the carton has a 2×6 matrix of cell pockets formed by a complementary 2×6 matrix of cells in each of the base and cover.

In one embodiment, a method of assembling the egg carton is provided, including filling each base cell with the jumbo eggs, closing the cover over the base and the lid over the assembled cover and base, wherein the hinges and domes of the base and cover cells accommodate the different size variations and orientations of the jumbo eggs in the cell pockets.

In another embodiment of the invention, a tri-fold plastic egg carton is provided comprising:

a cell base and a cell cover hingedly connected to one edge of the cell base for pivoting between open and closed positions, the base and the cover having respective peripheral edges that mate with each other in the closed position, and each of the base and the cover having a complimentary 2×6 matrix of cells that, when the cover is closed over the base, the cells of the cover and base are aligned and form a 2×6 matrix of cell pockets for holding individual eggs, each cell having a bottom wall and a sidewall extending upwardly from the bottom wall to form a corresponding one of the cells, a cell post formed at an intersection of four adjacent cells as an extension of the sidewalls of the four adjacent cells and having a central mating surface, wherein when the cover is in the closed position over the base the central mating surfaces of the cell posts of the base and cover mate with one another, a lid hingedly connected to another edge of the base for pivoting between open and closed positions, wherein when the cover and base are in the closed position the lid can be closed over the cover to form an assembled carton, the bottom wall of each base and cover cell comprising:

each cell pocket is sized to hold any different size variations of a jumbo egg, of from 2.50 to 3.00 ounces per egg, in an oriented or a non-oriented direction in the base cell;

a lowermost peripheral standing ring defining a base plane;

a recessed wall portion disposed radially inwardly from the peripheral standing ring and defining a central recessed area above the base plane, the recessed wall portion including a central dome in a concave out position in a relaxed state, a first circumferential hinge disposed radially outwardly of and surrounding the central dome, and a second circumferential hinge disposed radially outwardly of and surrounding the first hinge, the first and second hinges being in a contracted position in a relaxed state, wherein each of the upper and lower hinges are movable between their contracted position to one or more extended positions to move the central dome up and down in the central recessed area while remaining above the base plane while the central domes of the base cell and cover cell engage opposing ends of a jumbo egg of the different size variations and orientations.

In one embodiment, the carton is a solid sheet of clear polyester and the bottom wall has a thickness in a range of about 0.013 to about 0.022 inches.

In one embodiment, each cell has an arcuate, outwardly bowed sidewall portion sized to receive a major cell diameter of a jumbo egg in a range of about 1.75 to about 2.06 inches.

BRIEF DESCRIPTION OF THE DRAWINGS

The drawings depict various embodiments of the invention wherein.

DETAILED DESCRIPTION

Figure 1A:
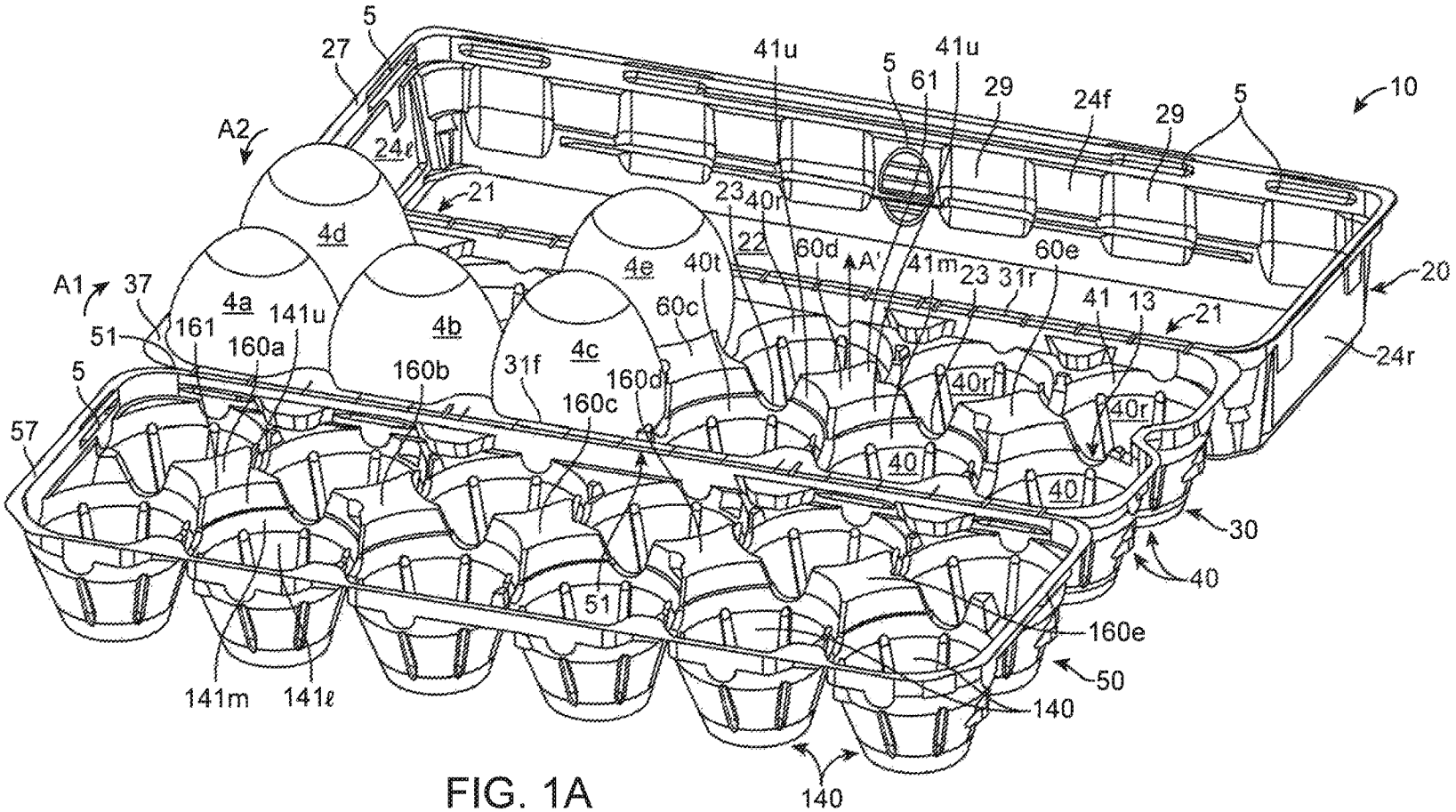
FIG. 1A is a top perspective view of an open egg carton according to one embodiment of the invention, showing a hinged cover, base and lid in the open position, with each of the base and cover including a complementary 2×6 matrix of egg receiving cells, and with five jumbo eggs 4*a*-4*e* of varying size and orientation disposed in five cells of the base.
Figure 2A:
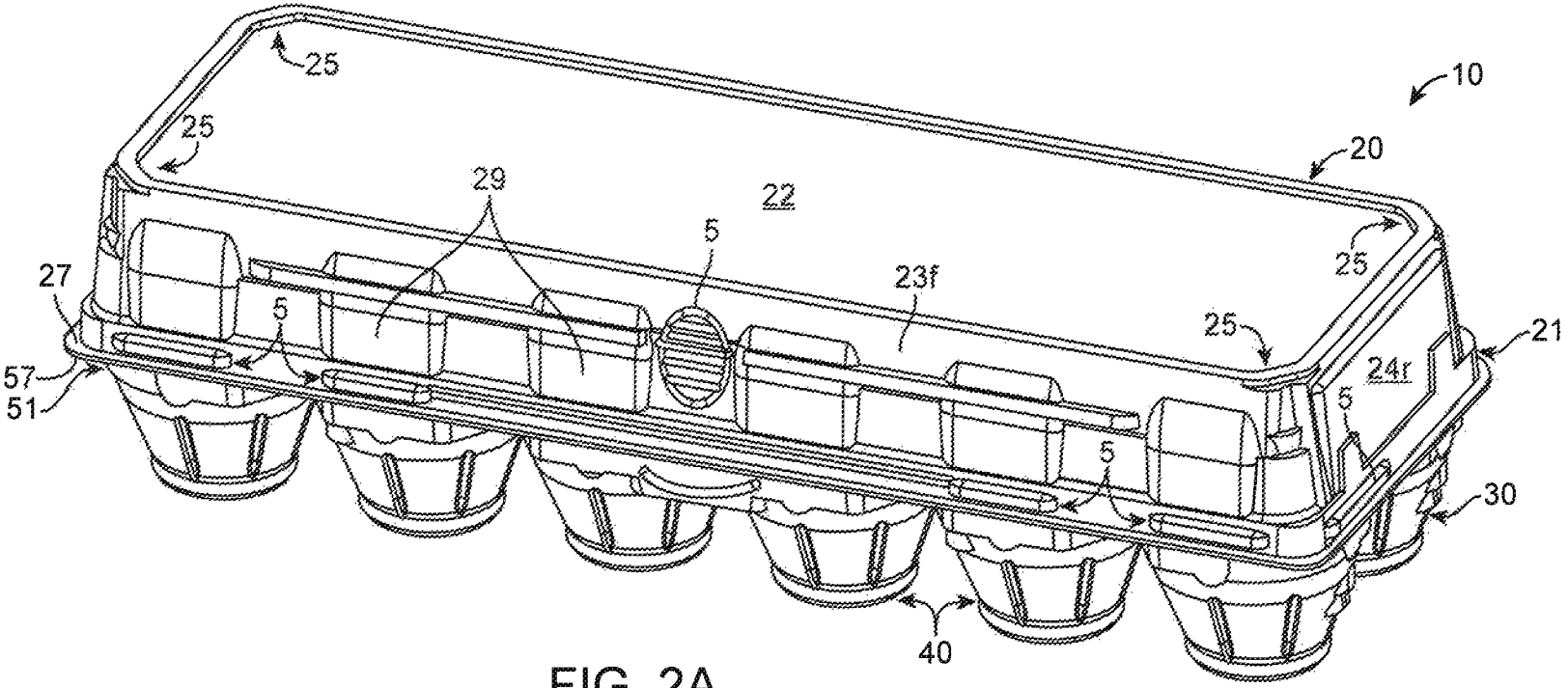
FIG. 2A is a top perspective view of the fully assembled carton of FIGS. 1A-1C, wherein the hinged cover has been folded over the base followed by the hinged lid being folded over the assembled cover and base.
Figure 2B:
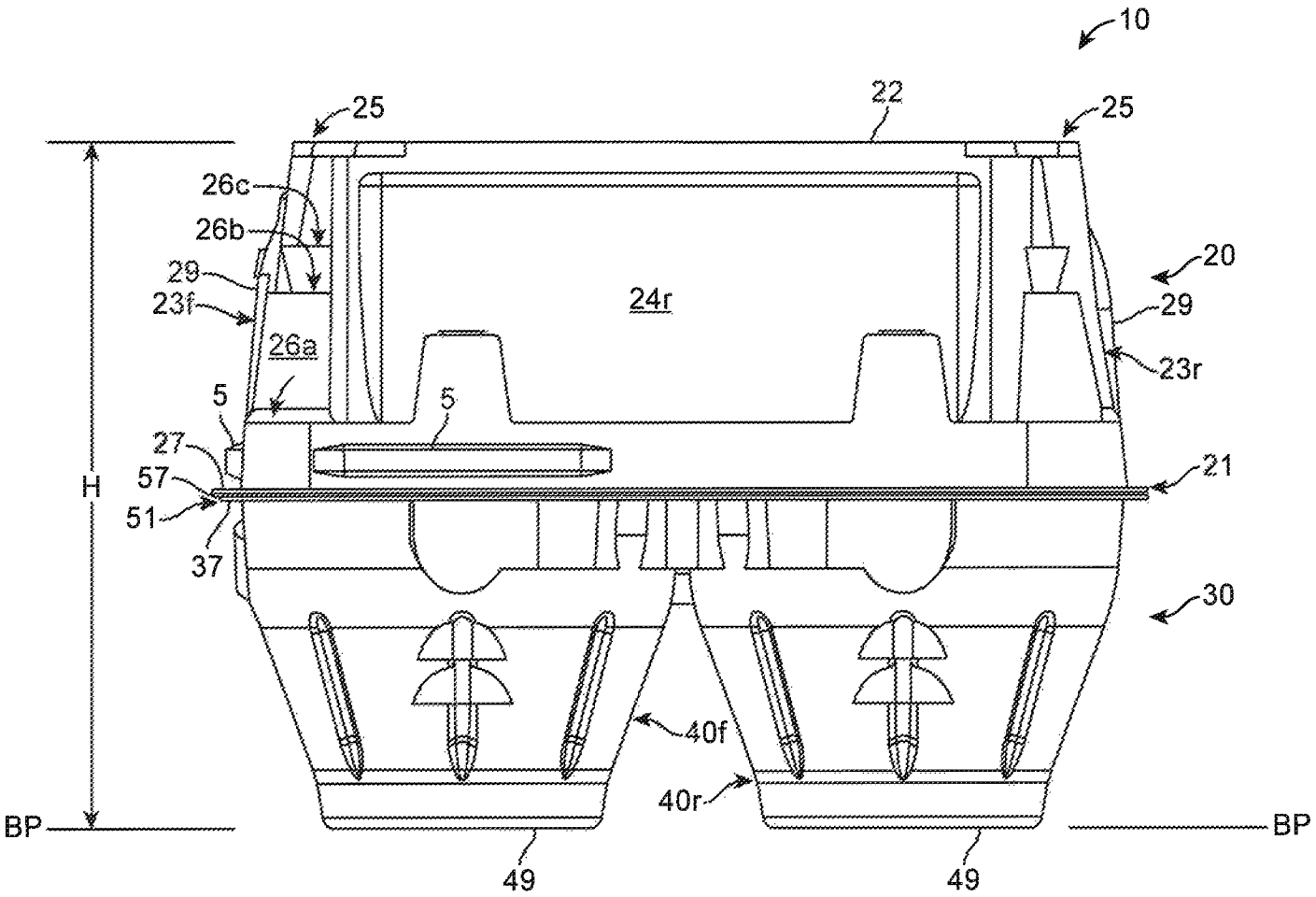
FIG. 2B is an end elevational view of the assembled carton of FIG. 2A.
Figure 2C:
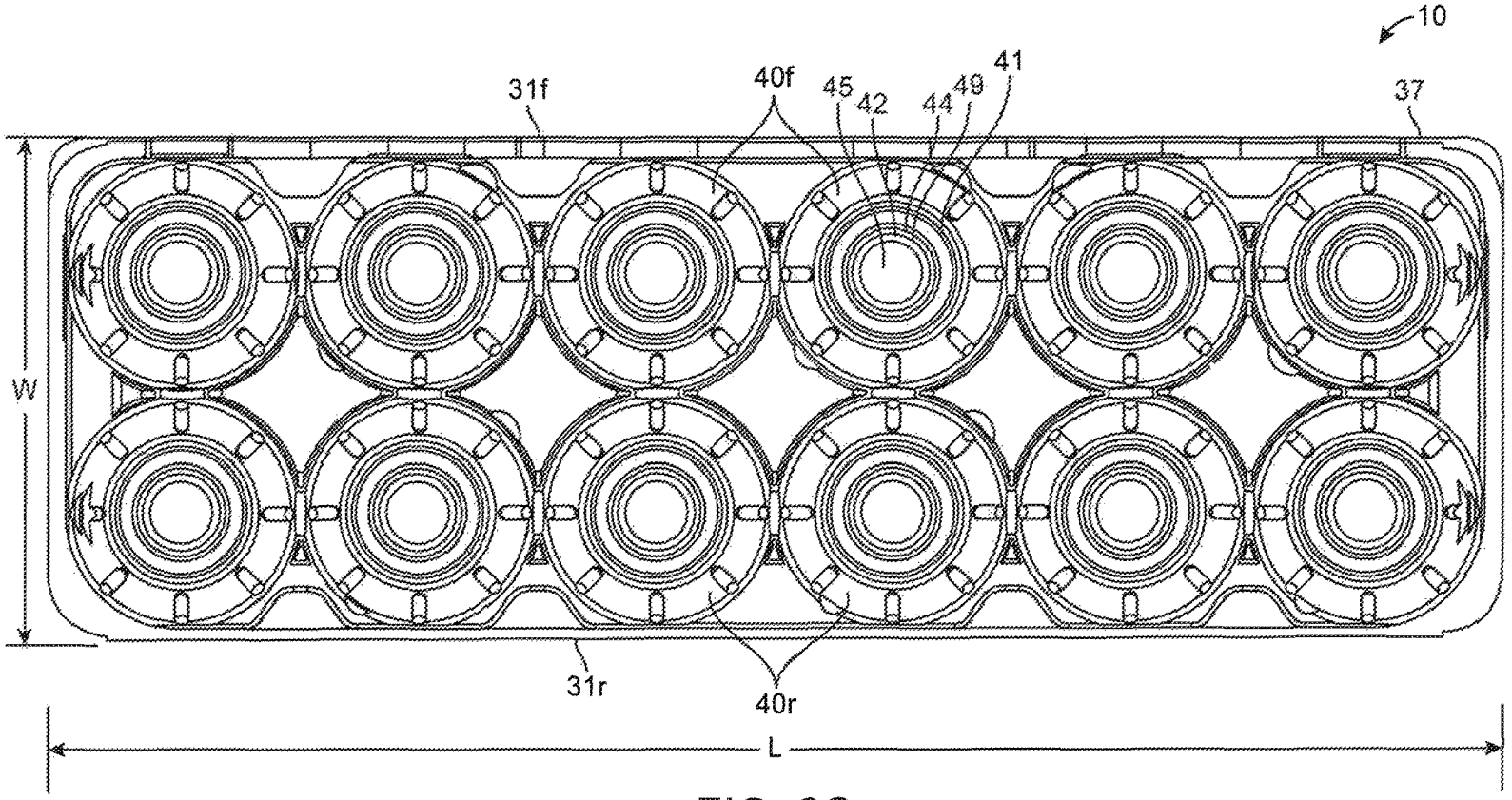
FIG. 2C is an bottom plan view of the assembled carton of FIG. 2A.
Figure 3:
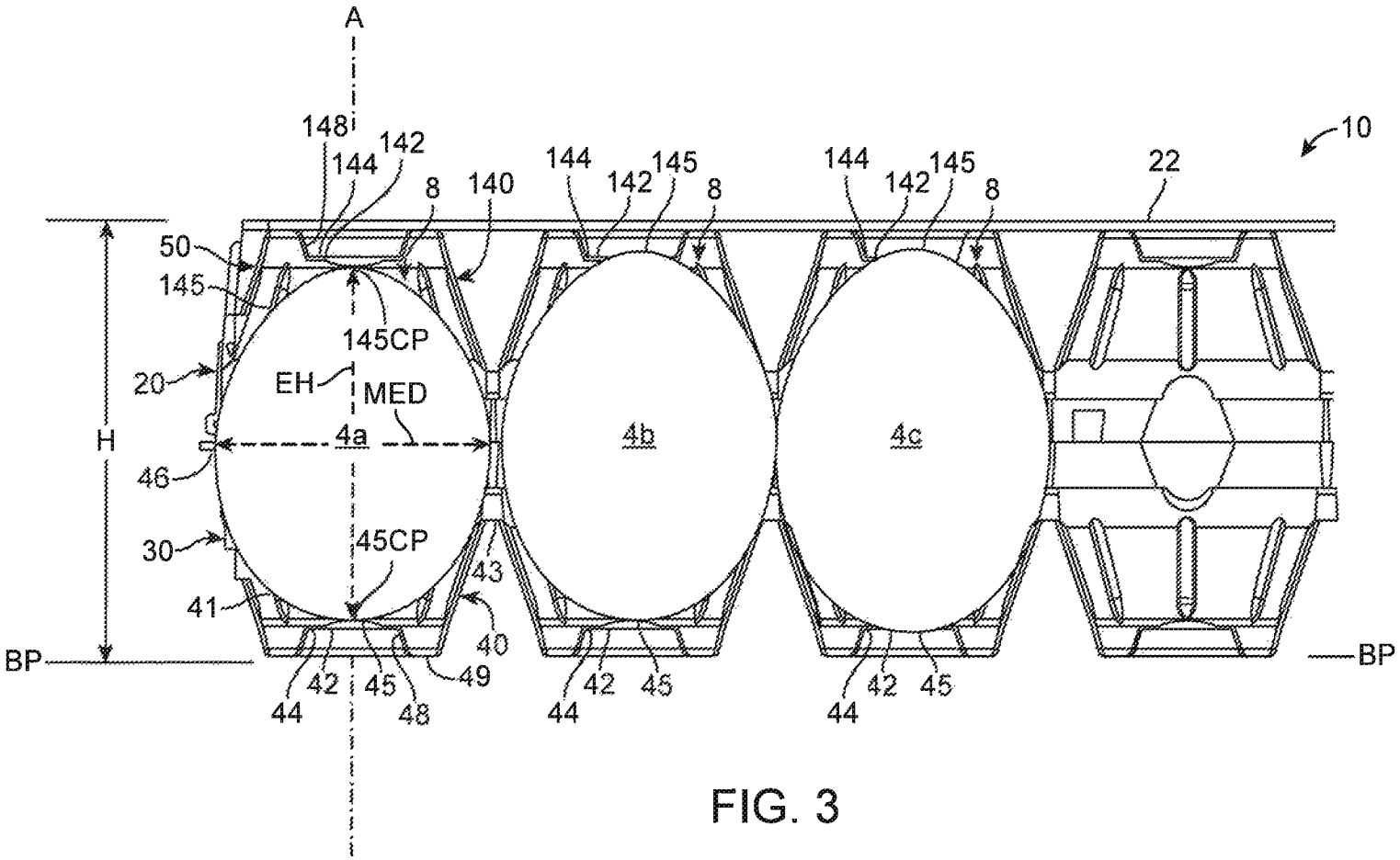
FIG. 3 is a longitudinal partial sectional view of four of the six cell pockets in the front row of the assembled carton of FIGS. 1A-2C, showing three of the different size eggs 4*a*-4*c* (short, mid-height, and tall) accommodated by the movable bottom walls of the base cells and cover cells in the three left-hand cell pockets of the front row.
Figure 4:
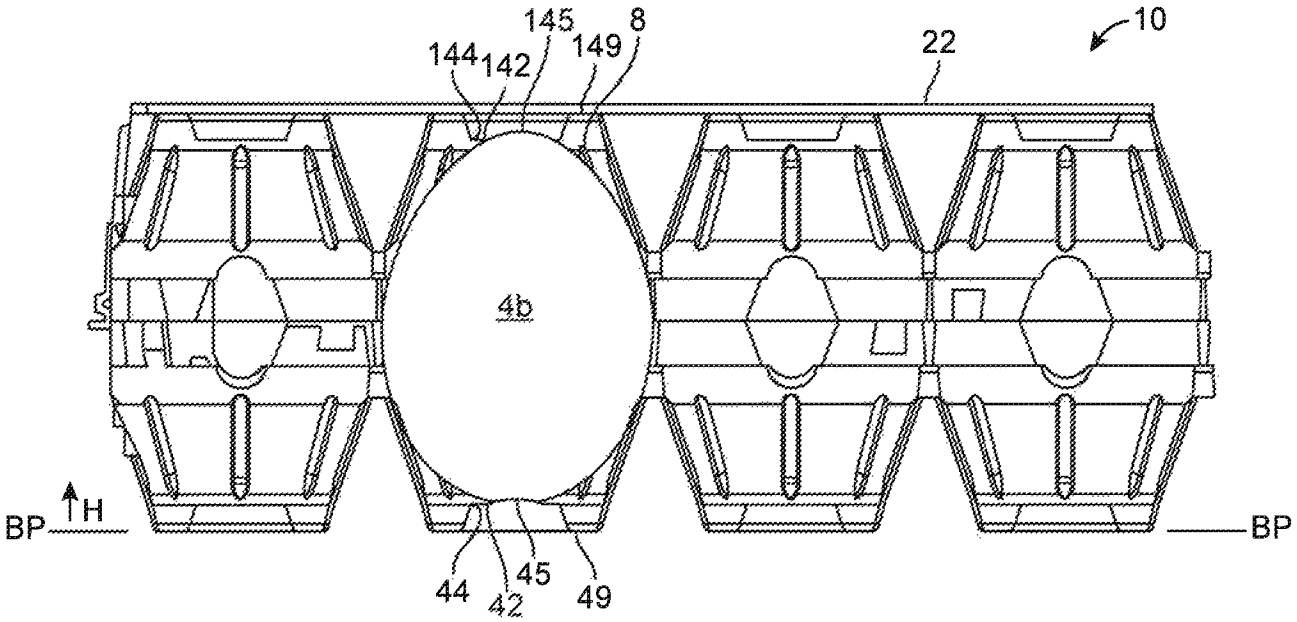
FIG. 4 is a longitudinal partial sectional view, similar to FIG. 3, showing one egg 4*b* of mid-height size accommodated by the movable bottoms of the base and cover cells in the cell pocket.
Figure 5:
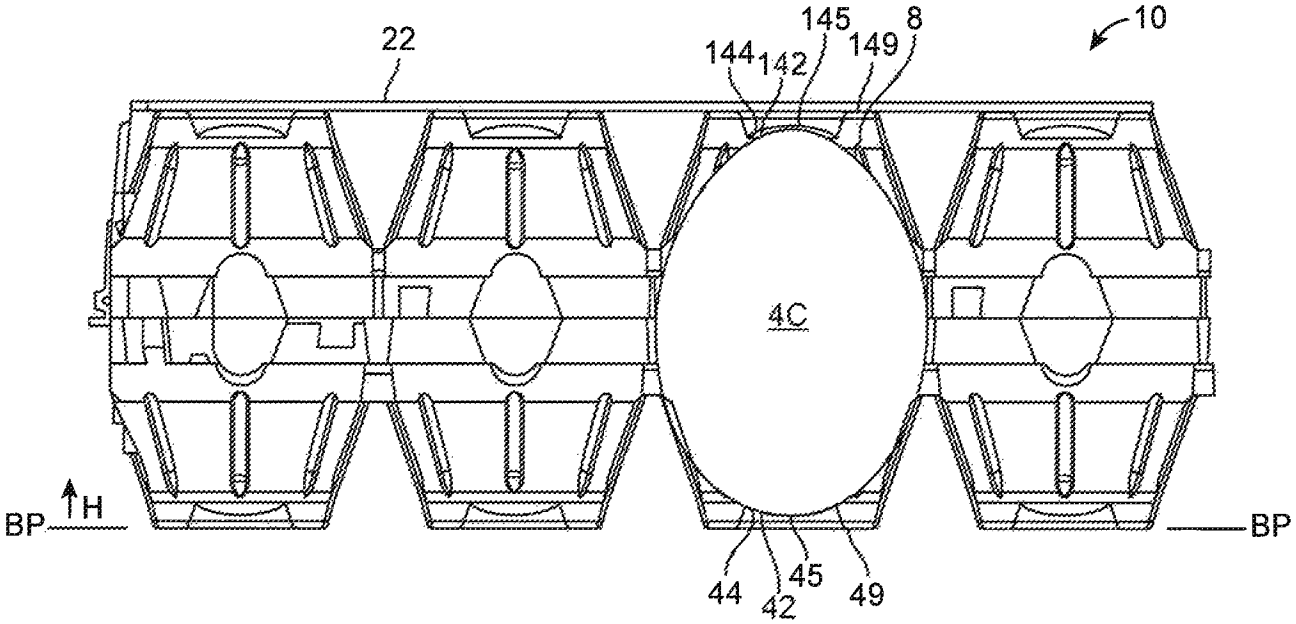
FIG. 5 is a longitudinal partial sectional view, similar to FIG. 3, showing one egg 4*c* of tall size accommodated by the movable bottoms of the base and cover cells in the cell pocket.

FIGS. 1A-5 illustrate one embodiment of a tri-fold plastic egg carton 10 according to the invention, the carton holding 12 eggs in a 2×6 rectilinear matrix, with each egg in an individual cell pocket, the cell pockets being formed when a 2×6 matrix of cells 140 in the cover 50 are positioned over a complementary aligned 2×6 matrix of cells 40 in the base 30. The cell pockets are designed to accommodate regular jumbo and super jumbo eggs in both oriented and non-oriented positions as described in greater detail below. For this purpose, FIGS. 1A-1C illustrate five eggs 4*a*-4*e* of different sizes and different orientations in the cell pockets: three different size non-oriented eggs 4*a*, 4*b*, 4*c* (small end up) in the front row of the base, and two different size oriented eggs 4*d*, 4*e* (small end down) in the back row. FIGS. 3-5 best illustrate how jumbo eggs of different sizes (and orientations) can be accommodated in the assembled carton, each protected in their own cell pocket, without contacting one another.

Figure 1B:
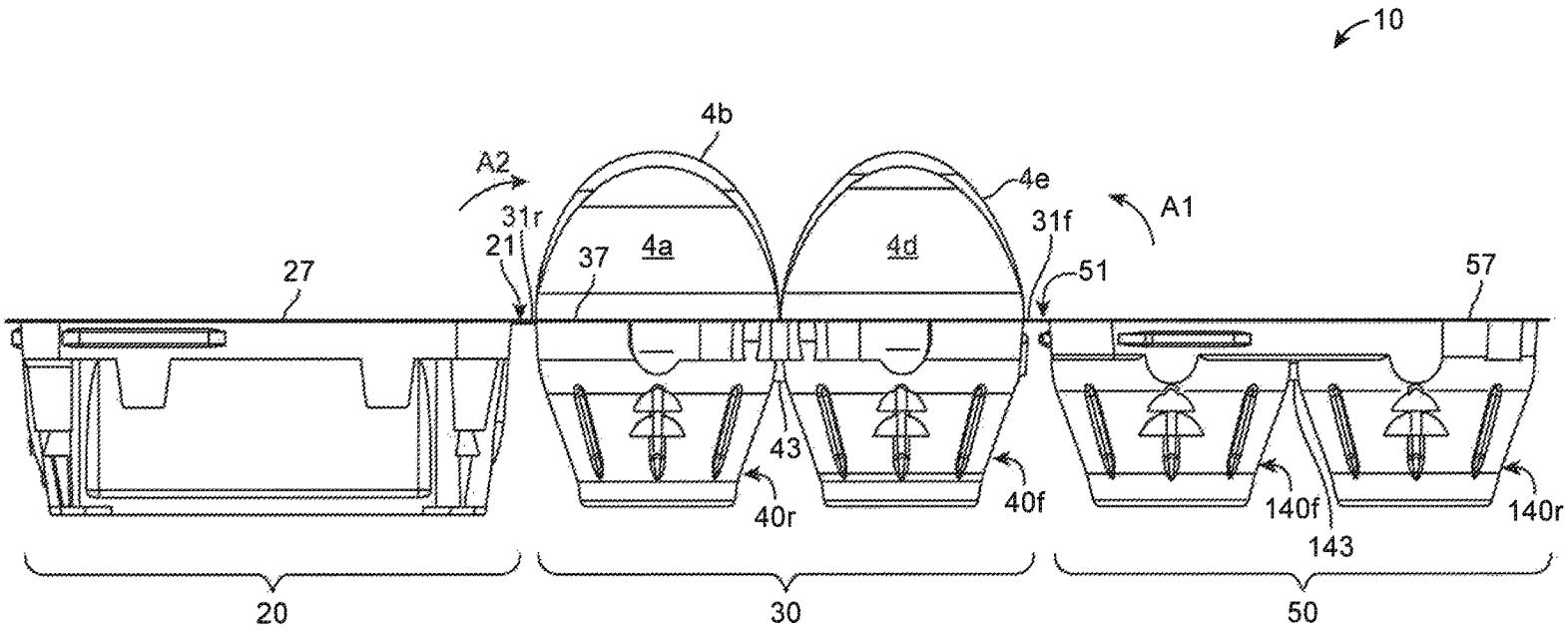
FIG. 1B is an end elevational view of the open carton of FIG. 1A, showing the different size and oriented jumbo eggs 4*a*-4*e* in profile.
Figure 1C:
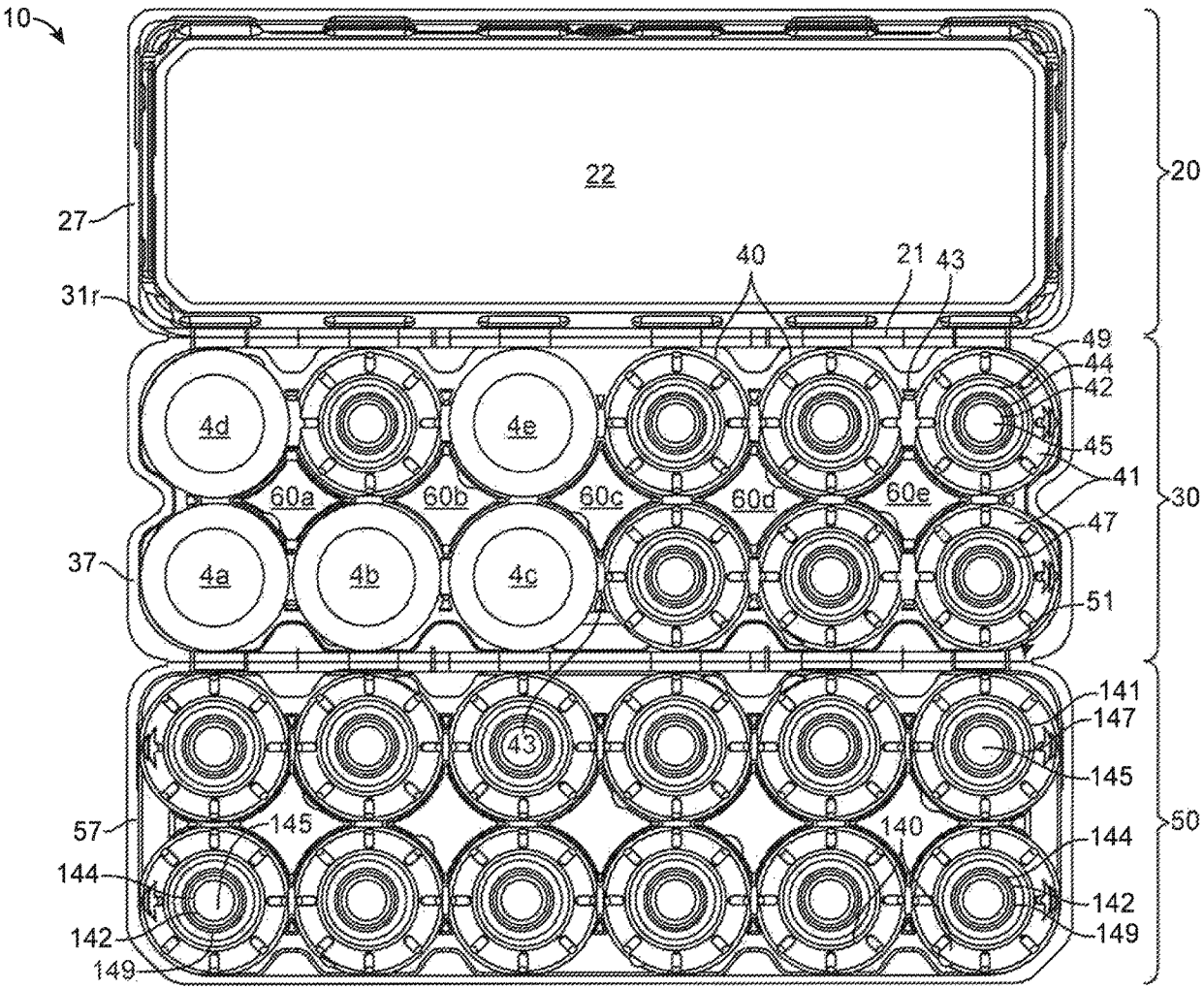
FIG. 1C is a top plan view of the open carton of FIG. 1A, showing the different size jumbo eggs 4*a*-4*e* from above.

FIG. 1A is a top perspective view of the interior of an open 2×6 matrix egg carton 10 according to one embodiment of the invention. FIGS. 1B and 1C show other views of the open carton and different size eggs. When closed (see FIGS. 2A-5) the carton 10 occupies a volume having a length L, width W, and height H (where H is transverse to a base plane BP on where the base of the assembled carton rests). The open and closed cross sectional views illustrate how the various size eggs 4*a*-4*e* can be accommodated in the cell pockets of the closed carton in accordance with various features of the present invention.

As shown in FIG. 1A, the carton includes of a lid 20 connected via a rear hinge 21 to the base 30, the base comprising a plurality of egg receiving cells 40 arranged in the 2×6 matrix. The matrix includes six front cells 40*f* arranged in a row along a front longitudinal edge 31*f* of the base, and six rear cells 40*r* arranged in a second row, parallel to the first row, extending along a rear longitudinal edge 31*r* of the base. At each cross-hair (+) intersection of four adjacent cells (2×2 matrix), a cell post 60 is provided, there being five cell posts 60*a*-60*e* equally spaced apart in a longitudinal row between the first and second rows of cells. Each cell is configured to have an interior contour (shape and dimensions) complimentary to accommodate the varying shape of regular jumbo and super jumbo eggs (as shown in FIGS. 3-5), allowing the egg to be positioned deep in the base cell (with one end of the egg adjacent the cell bottom wall) in both oriented and non-oriented positions. As used herein "complimentary" means conforming at least in part to the contour (size and shape) of the egg being held or the surface being mated with. It is contemplated that various sized eggs can be inserted into a base cell, in one or both of an oriented and non-oriented position. An egg has an egg height EH extending between a large end and a small end of the egg (see FIG. 3), and a maximum egg diameter MED, in a direction transverse to the egg height. In an oriented position in the cell pocket, the small end of the egg is disposed toward the bottom wall of the base cell (e.g., eggs 4*d* and 4*e* in FIGS. 1A-1C), with the MED disposed away from the bottom wall of the base cell, whereas in the non-oriented position the egg is oppositely disposed with the MED disposed toward the bottom wall of the base cell (e.g., eggs 4*a*-4*c* in FIGS. 1A-1C and 3-5).

In addition to the hinged lid 20 and base 30, the carton 10 includes a cover 50 connected via a front hinge 51 to the base 30, the front hinge 51 being disposed along the front longitudinal edge 31*f* of the base, opposite the rear hinge 21 connecting the lid to the opposing rear longitudinal edge 31*r* of the base. The cover has a 2×6 matrix of cover cells 140 configured to align with and fit over the 2×6 matrix of base cells 40, forming a 2×6 matrix of cell pockets 8. To close the carton, the hinged cover 50 is rotated about front hinge 51 (see arrow A1 in FIGS. 1A-1B) to a position on top of the base, followed by rotating the lid 20 about rear hinge 21 (see arrow A2 in FIGS. 1A-1B) to a position on top of the assembled cover and base. The fully assembled carton is shown in FIGS. 2A-5.

As described above, the tri-fold egg carton has a 2×6 matrix of base cells 40 and a 2×6 matrix of cover cells 140 which, when assembled one on top of the other, encapsulate each egg in an individual cell pocket 8 (see FIGS. 3-5). The features of the cover cells mirror those of the base cells and are given corresponding reference numbers in a 100 series (e.g., base cell 40 and cover cell 140). Each base cell 40 (and corresponding cover cell 140) has a bottom cell wall 47 comprising a lowermost standing ring 49 lying in a base plane BP, and radially inwardly of the standing ring, a recessed wall 48 including a central dome 45 and first and second radially spaced apart circumferential hinges 42, 44 that surround the central dome, enabling the dome to move up and down above the base plane (in the height direction of the closed carton) between multiple positions to accommodate jumbo eggs of varying dimensions (height and width) and orientation to hold them securely in their respective cell pocket. The base and cover further include full height cell posts 60, 160 with mating surfaces 61, 161 that engage in the assembled state. The carton further includes a lid 20 which fits over the cover 50 (of the assembled cover and base), in a secure and locked position.

In one example (see FIG. 3, left most egg 4*a*), the central dome 45 and the first and second hinges 42, 44 of the base cell, and the central dome 145 and first and second hinges of 142, 144 of the cover cell, remain in their as molded (retracted, also referred to as a relaxed state), with the central domes each being in a concave out position (retracted inwardly) and the hinges retracted inwardly (in the height direction), such that only the central point 45*cp* and 145*cp* of each dome engages a respective opposing end of a short jumbo egg 4*a*. In another example (see the tall egg 4*c* of FIGS. 3 and 5), the first and second hinges 42,44 and 142, 144 on both the base and cover cells open outwardly (expanding, in opposing height directions) and the central domes 45, 145 open outwardly (expanding, to a concave in position) to accommodate a tall jumbo egg without any of the cell bottom domes or hinges reaching the lowermost standing surface 49, 149 of their respective cell. In another example (see the mid-height egg 4*b* in FIGS. 3-4), only the first hinge 142 on the cover cell 140 opens outwardly and the cover cell dome 145 expands outwardly (to a concave in position), while the base cell dome 45 and hinges 42, 44 and 144 all remain retracted, to engage opposing ends of a mid-height jumbo egg 4*b*.

Returning to the overall carton design as shown in FIGS. 1A-2C, the lid 20 has a generally flat (planar) uppermost top wall 22 and a downwardly extending peripheral sidewall 23 having a lower edge 27 that mates with mating upper edges 57, 37 of the assembled cover and base. The lid is generally rectangular in shape and includes two opposing (left and right) lateral end walls 241 and 24*r* and two opposing longitudinal front and rear sidewalls 23*f* and 23*r*. The lid 20 further includes structural sidewall reinforcements, here comprising outwardly projecting wall portions 29 that also accommodate the larger diameter jumbo eggs, and a plurality of front and side latches 5 that engage with complimentary latches 5 on the outer surface of the cover, when the cover and lid are closed over the base (FIGS. 2A-2C).

In each of the four corners 25 of the lid, where a sidewall 23 joins an end wall 24, there are three shoulder portions all of which increase the mechanical strength (stiffness) of the lid. The shoulder portions also produce a gap between the lip edges of two open stacked upper and lower cartons, enabling an operator to insert a finger in the gap to separate the two cartons, or enabling a picker of an automated handling equipment to separate the open stacked cartons.

In addition to the two hinge connections 21, 51 at the rear and front longitudinal edges 31*r*, 31*f* of the base 30, the remaining top edges of the base, cover and lid have at their perimeter a flat trim lip edge 37, 57, 27 respectively. Each lip edge has a flat peripheral surface lying generally in a plane parallel to the base plane BP on which the lowermost base portions of the base cells rest. The peripheral surfaces form supporting surfaces, which engage in planar relation, to strengthen the carton against compressive forces applied in the height direction to the closed carton, such as when multiple cartons are stacked in a display case, in a shipping case, and other instances when multiple cases or containers (each holding a stack of cartons) are stacked one on top of the other.

There will now be provided a more detailed description of the cell and post structure of the base and cover which, when assembled, form the array of cell pockets each holding an individual egg.

As shown in FIGS. 1A-5, the base portion 30 of the carton 10 comprises a 2×6 matrix of egg-receiving cells 40, aligned along rows and columns of the cell matrix, each cell being formed to receive and accommodate a single egg. Each cell has a central cell axis A that extends axially down the center of the cell in the height H direction of the carton (see FIG. 3). Typically the axis A is disposed laterally (about 90 degrees) to the bottom plane B on which the lowermost surfaces (standing rings 49) of the base cells rest. Each cell 40 has a sidewall 41 having an interior receiving surface contoured to receive the ovoid shape of an egg. The sidewall 41 tapers upwardly and outwardly from a bottom cell wall 47 to define an open top end 46 of the cell. Two adjoining sidewalls 41, 41 between adjacent pairs of cells 40, 40, together define a cell junction 43, also referred to as a cell divider. The cell divider 43 preferably includes a rounded shoulder portion forming a top edge of the joined sidewalls. The sidewalls 41 are generally flexible to respond to pressure applied during packaging, transportation and/or storage of the eggs. A groove 15 may be formed in the top of the cell divider, to further strengthen the cell pocket structure. However, this groove is sufficiently narrow as to substantially avoid any side-to-side contact between the eggs in the respective adjacent cell pockets. Thus, each egg is held in a separate enclosure (cell pocket), out of contact with eggs in the adjacent cell pockets.

The cover 50 has a complimentary 2×6 matrix of cells 140 that, together with the base cells 40, form the cell pockets 8 for protecting each egg in an individual cell pocket. The complementary features of the cover cells are referenced by a 100 number series corresponding to the respective features of the base cells (e.g., base cell 40 has sidewall 41 and cover cell 140 has sidewall 141). FIG. 1C is a top plan view of the open carton showing the details of the interior of the bottom wall with the dome and hinges in the relaxed state.

The cells 40 that collectively form the base 30 have lowermost standing ring surfaces 49 that are substantially co-planar and lie substantially within a common plane BP on which the carton rests. This allows the planar bottom of one carton to be mechanically stacked or deposited on top of the uppermost planar lid surface 22 of another carton (see FIGS. 6-7). By force of gravity, the lowermost surfaces 49 bear against the top surfaces 22 to provide a degree of stability against lateral (LAT) or longitudinal (LONG) movement due to friction between the top surface 22 and bottom surfaces 49.

The bottom wall 47 (see FIGS. 1C, 2C and 3-5) of each cell includes an outermost circular standing ring 49 on which the carton rests in common base plane BP, the standing ring 49 surrounding a central recessed wall 48 having at its center a dome 45. The top or bottom end of an egg 4 will rest on the interior surface of the dome 45. The recessed wall 48 has two spaced apart circumferential hinges 42, 44, that enable the dome to move up and down within the area above the BP defined by the recessed wall 48, and enable the dome to flex inwardly (contracted state) and outwardly (expanded state) all the while maintaining the dome and hinges above the base plane BP on which the standing ring 49 rests. The cell bottom walls as molded (in their relaxed state), include the central dome contracted inwardly (concave outward shape) and the hinges contracted inwardly (toward the dome) in the height H direction. As described below, the dome 45 can then flex outwardly to accommodate a taller egg, and the hinges 42, 44 can also expand outwardly to accommodate a taller egg (e.g., egg 4*c* in FIG. 5).

The cell sidewall 41 has a lower portion 41L which is substantially linear (planar) and tapers upwardly and outwardly with respect to the standing ring 49 (in base plane BP); the lower portion 41L includes a plurality of spaced apart axial grooves 80 extending upwardly (in the H direction) for strengthening the cell sidewall. A middle portion 41M of the sidewall is arcuately curved (bowed) outwardly to accommodate the ovoid shape and maximum egg diameter MED of a jumbo egg. A third upper portion 41U of the sidewall comprises a sidewall extension that forms a sidewall of a cell post 60, which further engages and secures the egg in the cell pocket. Each sidewall extension 41U follows the ovoid contour of an egg disposed in the cell and extends to the full height of the plane in which the trim perimeter 37 of the base lies. The cover cell 140 has the same three sidewall portions 141L, 141M and 141U. As a result, a pair of base and cover cells is adapted to receive any of the various sized and oriented jumbo eggs (form 2.50 to 3.00 ounces per egg) in the cell pocket with the maximum egg diameter MED engaging one or more of the mid or upper portions of the cover or base sidewalls, while the top and bottom ends of the egg sit on or in the opposing domes 45, 145 of the opposing cell bottoms walls 47, 147 (which form the interior top and bottom surfaces of the respective cell pocket).

A cell post 60 is formed at each intersection (i.e., crosshair (+)) of four adjacent (2×2 matrix of) cells 40 in the base 30, the cell post comprising the extensions 41U of the intersecting sidewalls 41 of the four adjacent cells, and having a top planar cell post wall 61 disposed substantially in the same plane as the uppermost base perimeter 37 (see FIG. 1A). The cell post has a central axis A' (see FIG. 1A) that extends axially down the center of the cell post 60 and is aligned with the height direction H of the carton (as well as the central vertical axis A of the egg, shown in FIG. 3). The cell post is generally tubular in shape and typically hollow. The cover 50, hingedly connected to the base, has a complimentary row of five cell posts 160*a*-160*e* which extend downwardly towards the base for mating with the upwardly extending cell posts 60*a*-60*e* of the base when the cover 50 is aligned over the base 30 in a closed position (FIGS. 2A-5). The cell posts of the cover and base have complimentary top planar surfaces 61, 161 for mating when the cover is positioned over the base. As used herein, "mating" means adapted to prospectively contact or be disposed in close proximity to; actual contact between the mating surfaces may occur whenever the cover and base are in a closed position, or only when in a closed position and an additional force is applied to the carton, e.g., when stacking the cartons one on top of another and/or stacking side by side and/or moving the cartons.

The cells 40, 140, cell posts 60, 160 and cell dividers 43, 143 are dimensioned to allow each cell pocket to hold a jumbo size egg having a major cell diameter in a range of about 1.75 to about 2.06 inches, and an egg height in a range of 2.461 to 2.750 inches, in either an oriented or unoriented position . . . . In the present embodiment, the assembled carton holds 12 jumbo eggs in a 2×6 matrix of cell pockets and has an overall length L of from about 11.62 to about 12.00 inches, a width W of from about 3.95 to about 4.18 inches, and height H of from about 2.62 to about 3.125 inches.

Multiple such filled egg cartons 10 may be enclosed in outer containers (also referred to as cases or wire baskets) in various stacking patterns, e.g., in parallel or in a cross stacking arrangement, wherein successive vertical layers are disposed transverse to the adjacent layer. The container dimensions may be increased (over standard size container dimensions, e.g., for full case (30 dozen) of half case (15 dozen)) to accommodate a large carton footprint.

Figure 6:
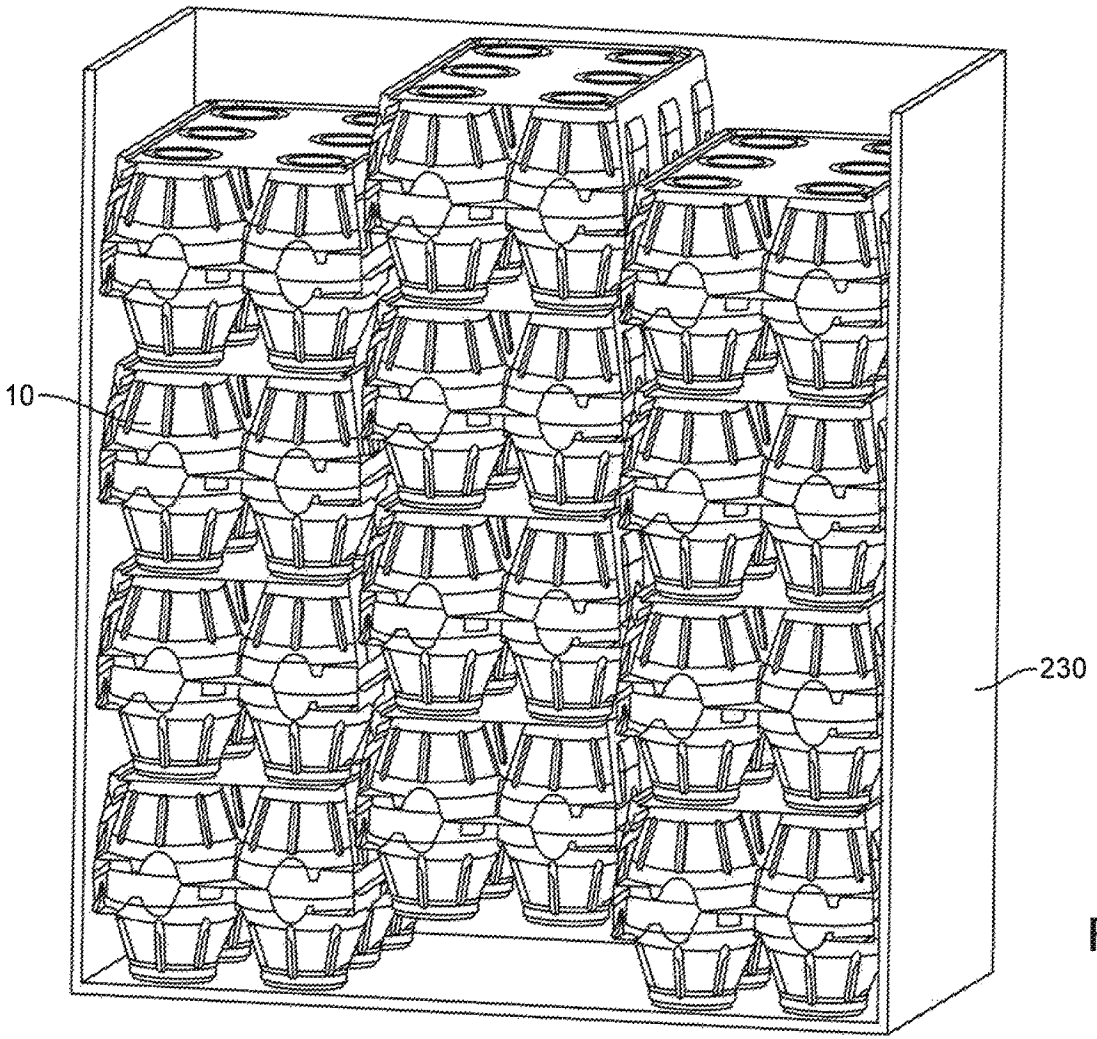
FIG. 6 is a perspective view of a container holding a stack of twelve of the 2×6 egg cartons of FIG. 2

Alternatively, a standard size half case rectilinear container 230 as shown in FIG. 6, that would normally hold 15, 2×6 egg cartons, in a 3×5 carton matrix, cross stacked, can now hold 12, 2×6 of the larger footprint cartons 10 (as shown in FIG. 2 and described herein) in a generally parallel stacking arrangement. The standard size half case container has inner dimensions of about: 12 inches×11⅞ inches×13½ inches. FIG. 6 shows a 4×3 stacked matrix of cartons 10, with the middle ($2^{nd}$ of 3) column of four vertically stacked cartons being offset vertically from the adjacent $1^{st}$ and $3^{rd}$ columns to accommodate the wider carton width of the carton described herein.

The teachings of this disclosure can be applied to forming different sized egg cartons, e.g., having a 2×2, 2×3, 2×4, 2×5, 2×6, 3×5, 3×6, 4×5 and 4×6 matrix of cell pockets.

In various embodiments, the plastic material of the egg carton is preferably one or more of polyester (e.g., polyethylene terephthalate (PET)), polyolefin (e.g., polyethylene (PE), or polypropylene (PP)), poly(lactic acid (PLA), or polystyrene (e.g., polystyrene foam), including homopolymers, copolymers, mixtures and blends thereof, and including virgin and reclaimed (recycled) materials.

In the present embodiment, the carton 10 is integrally formed from a sheet of molded plastic material, e.g., a clear solid sheet of polyester, such as polyethylene terephthalate (PET). The sheet from which the carton is integrally molded can then be shaped (formed) by a molding process, e.g., pressure forming with a plug assist in a mold to form the shaped lid, base and cover portions, including the lip edge, and then removing (trimming) any remaining portions of the sheet to form an integral carton.

While specific embodiments of the present invention have been shown and described, it will be apparent that many modifications can be made thereto without departing from the scope of the invention. Accordingly, the invention is not limited by the foregoing description.

The invention claimed is:

1. A molded article comprising a tri-fold plastic egg carton integrally formed from a sheet of molded plastic material, the egg carton comprising a base, and a cover hingedly connected to one edge of the base for pivoting between open and closed positions, the base and cover each having a complimentary rectilinear matrix of cells that together form a rectilinear matrix of cell pockets for holding individual eggs when the cover is closed over the base;

a lid hingedly connected to another edge of the base for pivoting between open and closed positions, wherein when the cover and base are in the closed position the lid can be closed over the cover to form an assembled carton;

each cell pocket having an arcuate, outwardly bowed sidewall portion sized to hold any different size variations of a jumbo egg, of from 2.50 to 3.00 ounces per egg, in an oriented or a non-oriented direction in the base cell;

each cell of the base and cover having a bottom wall comprising:

a lowermost peripheral standing ring defining a base plane; and a recessed wall portion disposed radially inwardly from the peripheral standing ring and defining a central recessed area above the base plane, the recessed wall portion including a central dome in a concave out position in a relaxed state, a first circumferential hinge disposed radially outwardly of and surrounding the central dome, and a second circumferential hinge disposed radially outwardly of and surrounding the first hinge, the first and second hinges as molded being in a contracted position in a relaxed state, wherein each of the first and second hinges are movable, expanding in a height direction transverse to the base plane, between their contracted position to one or more extended positions to move the central dome up and down in the central recessed area while remaining above the base plane while the central domes of the base cell and cover cell engage opposing ends of a jumbo egg of the different size variations and orientations.

2. The egg carton of claim 1, wherein the carton has a 2×6 matrix of the cell pockets formed by a complementary 2×6 matrix of cells in each of the base and cover, and the carton is a molded solid sheet of clear polyester.

3. The egg carton of claim 2, wherein the bottom wall has a thickness in a range of about 0.013 to about 0.022 inches.

4. The egg carton of claim 1, wherein the arcuate, outwardly bowed sidewall portion is sized to receive a major cell diameter of a jumbo egg in a range of about 1.75 to about 2.06 inches, and the cell pocket is configured to hold a jumbo egg in a height range of 2.461 to 2.750 inches, between the central domes of the base cell and cover cell.

5. The egg carton of claim 1, wherein each cell has a sidewall and the sidewalls of two adjacent cells form a cell divider which prevents contact between eggs in the adjacent cells.

6. The egg carton of claim 1, the non-hinged peripheral edges of the lid, cover and base each having a lip edge, the lip edges of the cover and base mating when the cover is closed over the base, and the lip edge of the lid being disposed over the mating lip edges of the cover and base when the lid is closed over the cover.

7. The egg carton of claim 1, wherein the assembled carton has a length of from about 11.62 to about 12.00 inches, a width of from about 3.95 to about 4.00 inches and a height of from about 2.62 to about 3.125 inches.

8. A stack comprising a plurality of assembled egg cartons of claim 7 arranged in a stack.

9. The stack of claim 8, further comprising a container holding the stack.

10. The stack of claim 9, wherein the container holds a full case or half case of the egg cartons.

11. The egg carton of claim 1, wherein the assembled carton is filled with jumbo eggs of the different size variations and orientations.

12. The egg carton of claim 1, wherein the plastic is one or more of polyester, polyethylene, polylatic acid, and polystyrene, including polymers, copolymers, mixtures and blends thereof.

13. The egg carton of claim 1, wherein the carton comprises a molded solid sheet of clear polyester.

14. The egg carton of claim 1, wherein the carton comprises a molded foamed sheet of polystyrene.

15. The egg carton of claim 1, wherein the lid has four sidewalls and four corners connecting the sidewalls and has structural reinforcements provided in each sidewall and corner.

16. The egg carton of claim 1, wherein the carton has a 2×6 matrix of cell pockets formed by a complementary 2×6 matrix of cells in each of the base and cover.

17. A method of assembling the egg carton of claim 1, including filling each base cell with the jumbo eggs, closing the cover over the base and the lid over the assembled cover and base, wherein the hinges and domes of the base and cover cells accommodate the different size variations and orientations of the jumbo eggs in the cell pockets.

18. A molded article comprising a tri-fold plastic egg carton integrally formed from a sheet of molded plastic material, the egg carton comprising:

a base and a cover hingedly connected to one edge of the base for pivoting between open and closed positions, the base and the cover having respective peripheral edges that mate with each other in the closed position, and each of the base and the cover having a complimentary 2×6 matrix of cells that, when the cover is closed over the base, the cells of the cover and base are aligned and form a 2×6 matrix of cell pockets for holding individual eggs, each cell having a bottom wall and a sidewall extending upwardly from the bottom wall to form a corresponding one of the cells, a cell post formed at an intersection of four adjacent cells as an extension of the sidewalls of the four adjacent cells and having a central mating surface, wherein when the cover is in the closed position over the base the central mating surfaces of the cell posts of the base and cover mate with one another, a lid hingedly connected to another edge of the base for pivoting between open and closed positions, wherein when the cover and base are in the closed position the lid can be closed over the cover to form an assembled carton;

each cell pocket having an arcuate, outwardly bowed sidewall portion sized to hold any different size variations of a jumbo egg, of from 2.50 to 3.00 ounces per egg, in an oriented or a non-oriented direction in the base cell;

the bottom wall of each base cell and cover cell comprising:

a lowermost peripheral standing ring defining a base plane; and a recessed wall portion disposed radially inwardly from the peripheral standing ring and defining a central recessed area above the base plane, the recessed wall portion including a central dome in a concave out position in a relaxed state, a first circumferential hinge disposed radially outwardly of and surrounding the central dome, and a second circumferential hinge disposed radially outwardly of and surrounding the first hinge, the first and second hinges as molded being in a contracted position in a relaxed state, wherein each of the first and second hinges are movable, expanding in a height direction transverse to the base plane, between their contracted position to one or more extended positions to move the central dome up and down in the central recessed area while remaining above the base plane while the central domes of the base cell and cover cell engage opposing ends of a jumbo egg of the different size variations and orientations.

19. The egg carton of claim 18, wherein the carton is a molded solid sheet of clear polyester and the bottom wall has a thickness in a range of about 0.013 to about 0.022 inches.

20. The egg carton of claim 19, wherein the arcuate, outwardly bowed sidewall portion is sized to receive a major cell diameter of a jumbo egg in a range of about 1.75 to about 2.06 inches.

* * * * *